US011326451B2

(12) United States Patent
Weinbach et al.

(10) Patent No.: US 11,326,451 B2
(45) Date of Patent: May 10, 2022

(54) PICK TOOL FOR ROAD MILLING

(71) Applicant: ELEMENT SIX GMBH, Burghaun (DE)

(72) Inventors: Eric Weinbach, Burghaun (DE); Bernd Heinrich Ries, Burghaun (DE)

(73) Assignee: Element Six GmbH, Burghaun (DE)

( * ) Notice: Subject to any disclaimer, the term of this patent is extended or adjusted under 35 U.S.C. 154(b) by 0 days.

(21) Appl. No.: 17/427,894

(22) PCT Filed: Feb. 6, 2020

(86) PCT No.: PCT/EP2020/052944
§ 371 (c)(1),
(2) Date: Aug. 2, 2021

(87) PCT Pub. No.: WO2020/161218
PCT Pub. Date: Aug. 13, 2020

(65) Prior Publication Data

US 2022/0042414 A1 Feb. 10, 2022

(30) Foreign Application Priority Data

Feb. 7, 2019 (GB) ..... 1901712

(51) Int. Cl.
*E21C 35/18* (2006.01)
*E21C 35/183* (2006.01)
*E21B 10/56* (2006.01)

(52) U.S. Cl.
CPC ..... *E21C 35/1835* (2020.05); *E21B 10/56* (2013.01)

(58) Field of Classification Search
CPC ..... E21C 35/1835; E21C 35/1837; E21C 35/1831; E21C 35/18; E21C 35/19; E21B 10/56
See application file for complete search history.

(56) References Cited

U.S. PATENT DOCUMENTS

| | | | | |
|---|---|---|---|---|
| 4,941,711 | A | 7/1990 | Stiffler | |
| 11,230,925 | B2 * | 1/2022 | Ries | E21C 35/1837 |
| 2008/0309148 | A1 | 12/2008 | Hall et al. | |
| 2009/0051212 | A1 | 2/2009 | Monyak et al. | |
| 2009/0066149 | A1 | 3/2009 | Hall et al. | |
| 2009/0256413 | A1 * | 10/2009 | Majagi | E21C 35/183 299/111 |

(Continued)

FOREIGN PATENT DOCUMENTS

| | | | |
|---|---|---|---|
| CA | 1307011 | C | 9/1992 |
| CN | 203808999 | U | 9/2014 |

(Continued)

OTHER PUBLICATIONS

GB Patent Application No. GB1901712.8 "Combined Search and Examination Report under Section 17 and 18(3)", dated May 24, 2019, 5 pages.

(Continued)

*Primary Examiner* — Carib A Oquendo
(74) *Attorney, Agent, or Firm* — Kilpatrick Townsend & Stockton LLP

(57) ABSTRACT

This disclosure relates to a pick tool with a PCD impact tip. The impact tip is joined to a support body at a non-planar first interface. The non-planar first interface comprises two co-axial and annular interface surfaces of differing radial widths.

16 Claims, 9 Drawing Sheets

(56) References Cited

U.S. PATENT DOCUMENTS

| | | | | |
|---|---|---|---|---|
| 2010/0264721 | A1* | 10/2010 | Hall | E21C 35/18 299/106 |
| 2011/0254350 | A1* | 10/2011 | Hall | E21C 35/183 299/113 |
| 2013/0002004 | A1 | 1/2013 | Greenspan et al. | |
| 2013/0181501 | A1 | 7/2013 | Hall | |
| 2013/0341999 | A1* | 12/2013 | Hall | E21C 35/18 299/105 |
| 2015/0198040 | A1 | 7/2015 | Voitic et al. | |
| 2016/0003041 | A1* | 1/2016 | Fader | E21C 35/197 299/113 |
| 2017/0234128 | A1 | 8/2017 | Ries et al. | |
| 2018/0245467 | A1* | 8/2018 | Kenno | E21C 35/183 |

FOREIGN PATENT DOCUMENTS

| | | | |
|---|---|---|---|
| EP | 2795062 | B1 | 10/2014 |
| EP | 2851507 | A1 | 3/2015 |
| GB | 2490795 | A | 11/2012 |
| JP | S6030795 | A | 2/1985 |
| JP | H03503430 | A | 8/1991 |
| JP | H03503793 | A | 8/1991 |
| JP | 2017082586 | A | 5/2017 |
| JP | 2017525876 | A | 9/2017 |
| JP | 2017526840 | A | 9/2017 |
| RU | 2459077 | C1 | 8/2012 |
| WO | 2014049162 | A2 | 4/2014 |
| WO | 2018162442 | A1 | 9/2018 |

OTHER PUBLICATIONS

GB Patent Application No. GB2001580.6 "Combined Search and Examination Report under Section 17 and 18(3)", dated Jun. 9, 2020, 8 pages.

International Application No. PCT/EP2019/082369, "International Preliminary Report on Patentability", dated Nov. 10, 2020, 13 pages.

International Application No. PCT/EP2020/052944 "International Search Report and Written Opinion", dated Apr. 30, 2020, 12 pages.

International Application No. PCT/EP2020/052944 "International Preliminary Report on Patentability", dated Jan. 15, 2021, 24 pages.

* cited by examiner

PICK TOOL FOR ROAD MILLING

FIELD OF THE INVENTION

The invention relates to a wear resistant pick tool for use in mining, milling and excavation. Particularly but not exclusively, the pick tools may include tips comprising polycrystalline diamond (PCD) material.

BACKGROUND ART

Pick tools are commonly used for breaking, boring into or otherwise degrading hard or abrasive bodies, such as rock, asphalt, coal or concrete and may be used in applications such as road reconditioning, mining, trenching and construction.

Pick tools can experience extreme wear and failure in a number of ways due to the environment in which they operate and must be frequently replaced. For example, in road reconditioning operations, a plurality of pick tools may be mounted on a rotatable drum and caused to break up road asphalt as the drum is rotated. A similar approach may be used to break up rock formations such as in coal mining.

Some pick tools comprise a working tip comprising synthetic diamond material, which is likely to have better abrasion resistance than working tips formed of cemented tungsten carbide material. However, synthetic and natural diamond material tends to be more brittle and less resistant to fracture than cemented metal carbide material and this tends to reduce its potential usefulness in pick operations.

There is a need to provide a pick tool having longer working life.

In particular, there is a need to provide a pick tool with a cemented metal carbide impact tip that helps to protect the steel support body at no additional cost.

SUMMARY OF THE INVENTION

According to the invention, there is provided a pick tool comprising a central axis, an impact tip and a support body, a proximal end of the impact tip joined to the support body at a non-planar interface, the non-planar interface comprising two co-axial and annular interface surfaces, the width of an outer interface surface being the same or less than the width of an inner interface surface, the impact tip comprising a super-hard bit at a distal end thereof.

This configuration provides a large brazing surface, which increases the compressive stresses after brazing. This leads to a higher shear strength.

When the width of the outer interface surface is the same or less than the width of the inner interface surface, braze material is encouraged to flow radially inwardly during the brazing process, which again contributes to achieving the higher shear strength post-braze.

Furthermore, the wear resistance of the pick tool as a whole is significantly improved. This avoids the situation where the pick tool fails because of wear of the steel support body despite the carbide tip having useful life remaining. With this configuration, the investment made into the carbide impact tip is realised because full lifetime usage is achieved.

Additionally, the brazing process is more flexible in terms of manufacturing tolerance because of the large brazing surface area. The arrangement also yields a more reliable brazing process.

Finally, the quality checking of the pick tools is much easier because no preparation of the sample is required before sectioning the sample to inspect the weld quality.

Preferable and/or optional features of the invention are provided in the dependent claims.

BRIEF DESCRIPTION OF THE DRAWINGS

A non-limiting example arrangement of a pick tool will be described with reference to the accompanying drawings, in which.

The same reference numbers refer to the same general features in all drawings.

DESCRIPTION OF EMBODIMENTS

Figure 1:
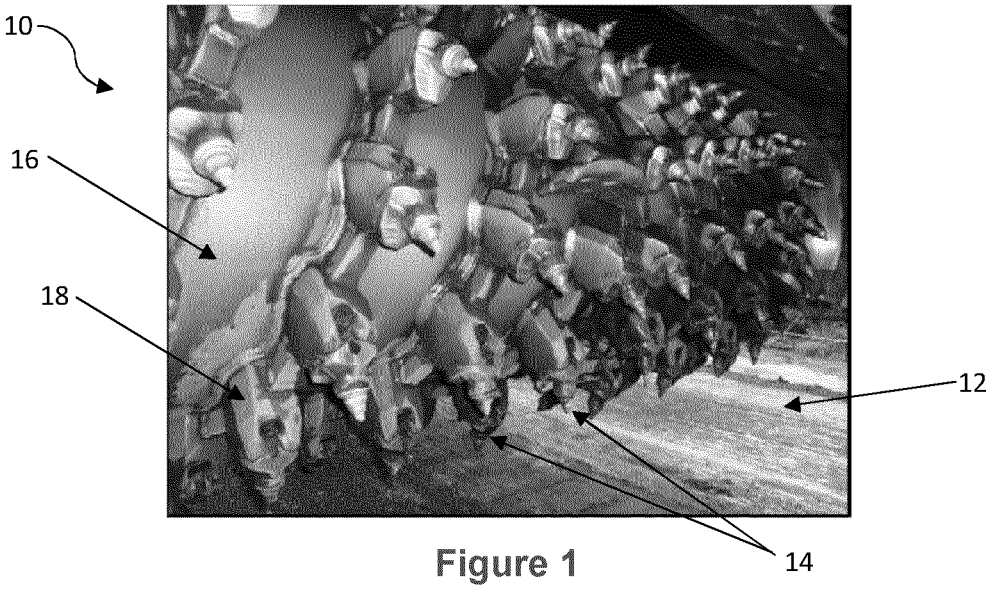
FIG. 1 shows an underside of a typical road-milling machine, incorporating prior art pick tools.

FIG. 1 shows an underside of a typical road-milling machine 10. The milling machine may be an asphalt or pavement planer used to degrade formations such as pavement 12 prior to placement of a new layer of pavement. A plurality of pick tools 14 are attached to a rotatable drum 16. The drum 16 brings the pick tools 14 into engagement with the formation 12. A base holder 18 is securely attached to the drum 16 and, by virtue of an intermediate tool holder (not shown), may hold the pick tool 14 at an angle offset from the direction of rotation such that the pick tool 14 engages the formation 12 at a preferential angle. In some embodiments, a shank (not shown) of the pick tool 14 is rotatably disposed within the tool holder, though this is not necessary for pick tools 14 comprising super-hard impact tips.

Figure 2:
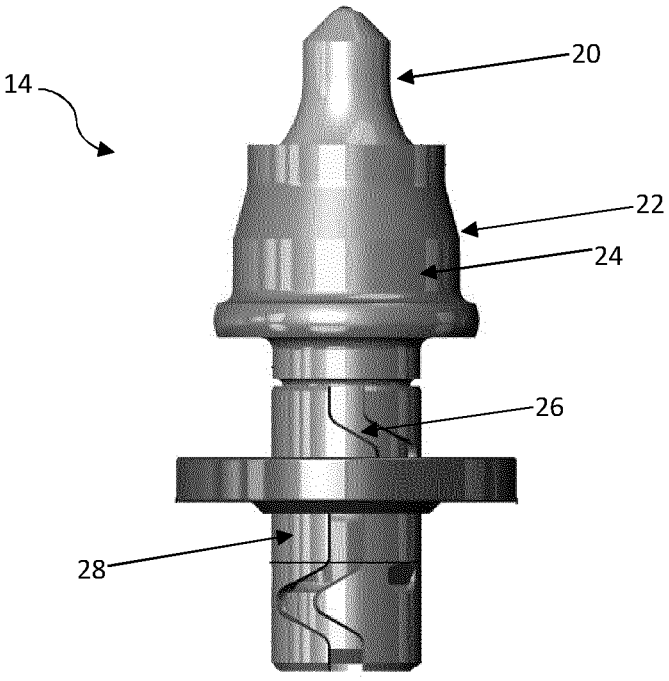
Figure 2 (Prior Art)
FIG. 2 shows a front perspective view of a prior art pick tool.
Figure 3:
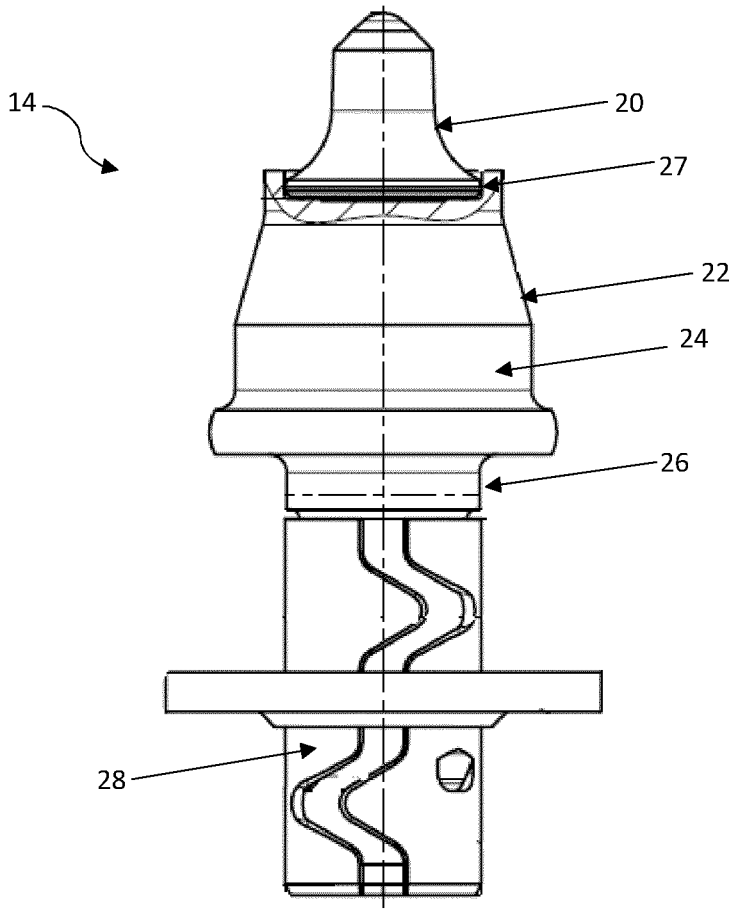
Figure 3 (Prior Art)
FIG. 3 shows a front perspective view of the prior art pick tool of FIG. 2 with partial cross-section of the interface between the impact tip and the support body.

FIGS. 2 and 3 show a prior art pick tool 14. The pick tool 14 comprises a generally bell shaped impact tip 20 and a steel support body 22. The support body comprises a body portion 24 and a shank 26 extending centrally from the body portion 24. The impact tip 20 sits within a circular recess 27 provided in one end of the support body 22. This means that an edge of the steel support body 22 always surrounds the metal carbide impact tip 20. Braze material (not shown), typical provided as a thin circular disc, positioned within the circular recess 27 securely joins the impact tip 20 to the support body 22. The pick tool 14 is attachable to a drive mechanism, for example, of a road-milling machine, by virtue of the shank 26 and a spring sleeve 28 surrounding the shank 26 in a known manner. The spring sleeve 28 enables relative rotation between the pick tool 14 and the tool holder.

Figure 4:
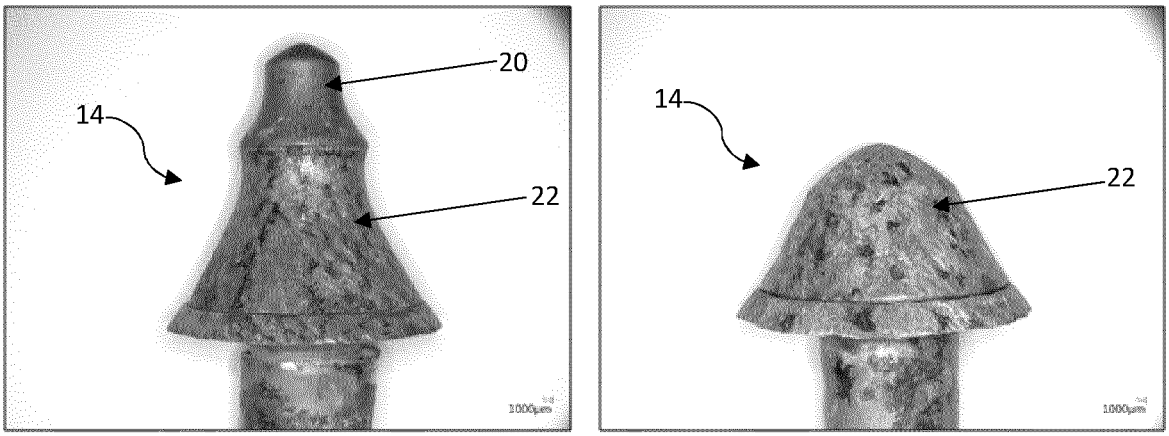
Figure 4 (Prior Art)
FIG. 4 shows an example of a worn prior art pick tool before (left) and after (right) the impact tip has broken off.
Figure 5:
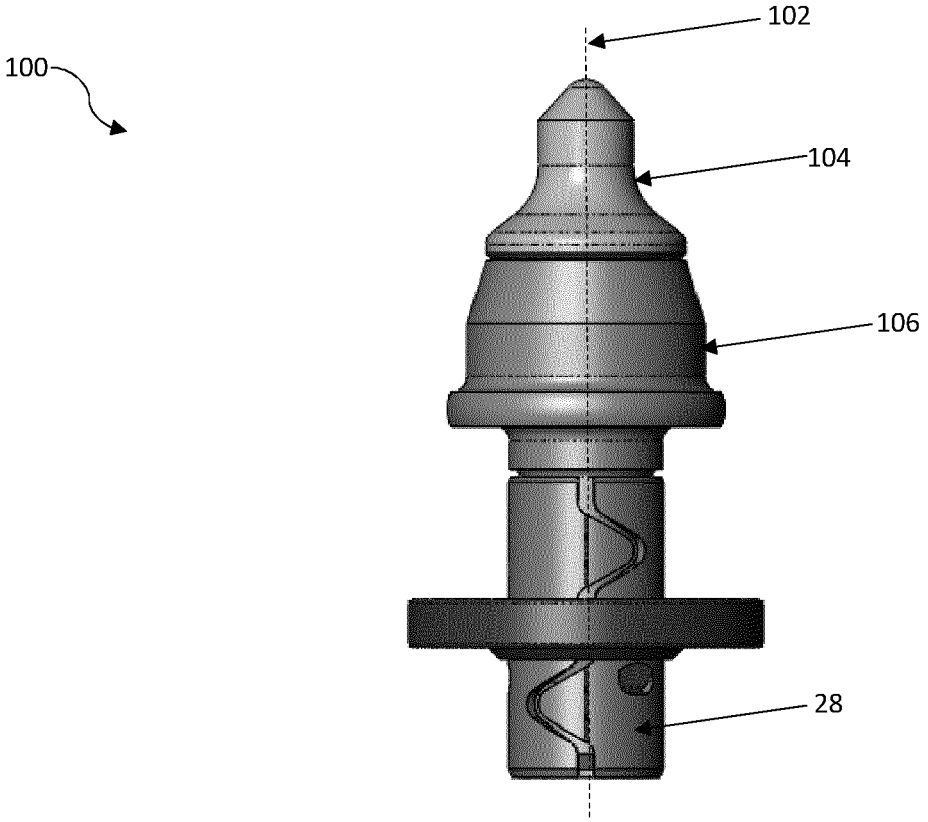
FIG. 5 shows a front perspective view of a pick tool in one embodiment of the invention.

In use, as evidenced in FIG. 4, the steel support body 22 erodes at a faster rate than the carbide impact tip 20, particularly near the braze. The volume of steel in this area gradually decreases in use due to abrasion. Eventually, the support body 22 can no longer sufficiently support the impact tip 20 and the impact tip 20 breaks off, prematurely terminating the useful life of the impact tip 20.

Figure 6:
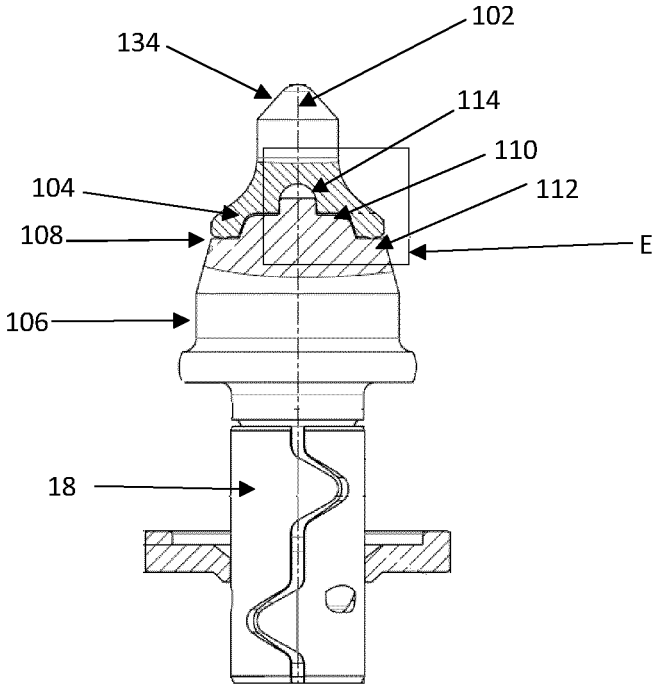
FIG. 6 shows a cross-sectional view of the pick tool of FIG. 5.

Turning now to FIGS. 5 to 10, a first embodiment of a pick tool in accordance with the invention is indicated generally at 100. The pick tool 100 comprises a central axis 102, an impact tip 104 and a support body 106. The spring sleeve 28 is not essential to the invention and may be omitted. The pick tool 100 is symmetrical about its central axis 102. As best seen in FIG. 6, the impact tip 104 is joined to the support body 106 at a non-planar interface 108. Significantly, the interface 108 comprises two co-axial and annular interface surfaces 110, 112.

Figure 7:
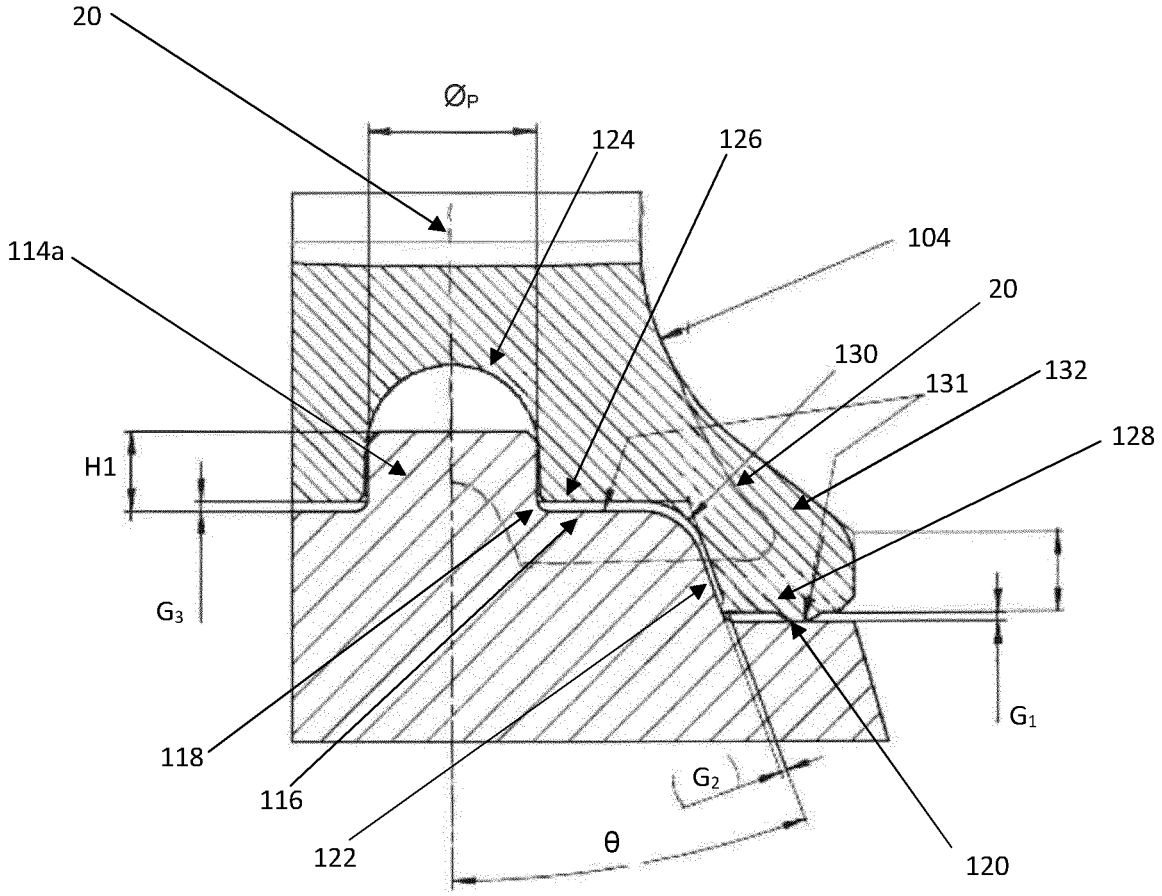
FIG. 7 shows an enlarged view of part of square E in FIG. 5; and also in outline a cross-section of the prior art pick of FIG. 2.

The support body 106 comprises a central protrusion or pin 114, which is surrounded by and extends radially outwardly into a first annular joining surface 116 (see FIG. 7). In this embodiment, the central protrusion 114 is a boss and comprises a cylindrical body portion 114*a*. However, other shapes and profiles of central protrusion 114 are envisaged, such as a conical protrusion or a truncated conical protrusion, or a hemispherical protrusion. A diameter $Ø_P$ of the cylindrical body portion 114*a* is preferably around 5 mm but may be in the range of 3 mm to 10 mm. A height $H_1$ of the cylindrical portion 114*a* is preferably around 2.5 mm but may be in the range of 1 mm to 5 mm. The central protrusion 114 may be undercut by an arcuate notch 118. The notch provides an additional volume into which braze material can flow, and helps contribute to the large brazing area.

The first annular joining surface 116 is connected to a radially outer second annular joining surface 120 by means of shoulder 122. In FIG. 7, the shoulder 122 is initially arcuate and then rectilinear. It is positioned intermediate the first and second annular joining surfaces 116, 120. Whereas the first and second annular joining surfaces 116, 120 are arranged perpendicularly to the central axis 102, the shoulder 122 is arranged at an acute angle θ to the central axis 102, as shown in FIG. 7. The angle θ is between 10 and 30 degrees, and is preferably about 20 degrees.

The first and second annular joining surfaces 116, 120 are separated axially, i.e. stepped, such that the first annular joining surface 116 is axially intermediate the central protrusion 114 and the second annular joining surface 120. It is feasible that the second annular joining surface 120 could be axially intermediate the central protrusion 114 and the first annular joining surface 116 instead, but this is not a preferred arrangement because it likely requires more (not less) carbide material in the impact tip 104.

Figure 8:
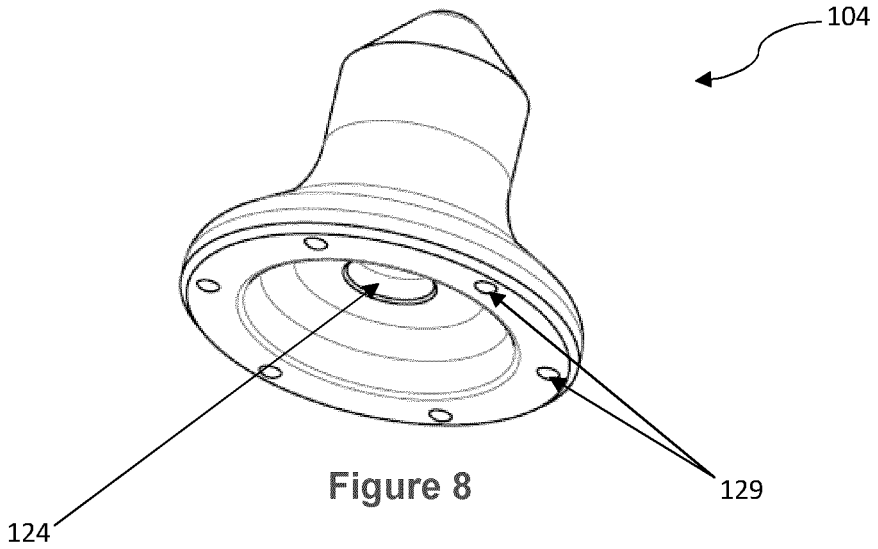
FIG. 8 shows a perspective view of the impact tip of FIG. 5.

As shown in FIG. 8, the impact tip 104 comprising a central recess 124 at one end for receiving the central protrusion 114 of the support body 106. The internal configuration of the recess 124 is part hemispherical and part cylindrical, but other shapes are possible. The role of the central protrusion 114 and recess 124 is to ensure good relative location of the impact tip 104 and the support body 106 in the initial assembly, during the early stages of production. They also assist during pressing to improve the density of the green body, at the pre-sintering stage. However, they are not essential to the invention in that they do not directly contribute to an increased weld strength and, as such, they may be omitted. Whether or not the protrusion 114 and recess 124 are included in the impact tip, it is important that the first and second annular interface surfaces 110, 112 are spaced apart axially to some extent.

The impact tip 104 further comprises a third annular joining surface 126 surrounding and extending radially outwardly from the central recess 124. The impact tip 104 also comprises a radially outer fourth annular joining surface 128 connected to the third annular joining surface 126.

Figure 9:
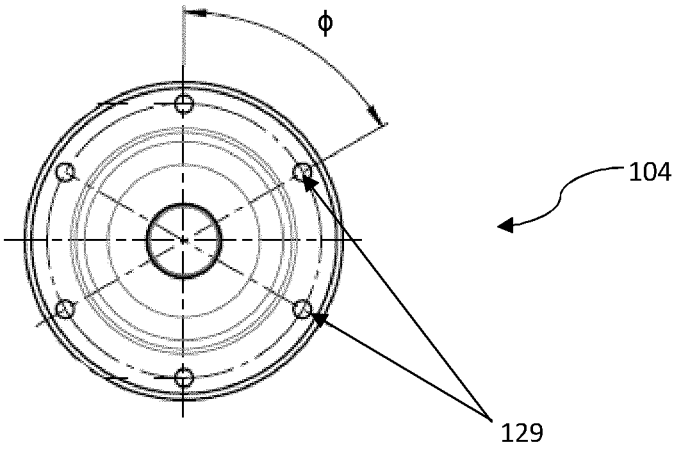
FIG. 9 shows a bottom view of the impact tip of FIG. 5.

As best seen in FIGS. 8 and 9, a plurality of dimples 129 protrude from the fourth annular joining surface 128. The dimples 129 are equi-angularly arranged about the central longitudinal axis 102. In this embodiment, the angular spacing ϕ) between adjacent dimples is 60 degrees since there are 6 dimples. Any number of dimples may be arranged on the fourth annular joining surface 128. The dimples help to create a small gap $G_1$ of around 0.3 mm between the impact tip 104 and the support body 106. The dimples further increase the surface area of the impact tip 104 against which the braze bonds, yet further enhancing the shear strength of the join.

Similar to the support body 106, a second said shoulder 130 connects the third and fourth annular joining surfaces 126, 128 of the impact tip 104.

In this embodiment, the first and second shoulders, 122, 130 are planar. However, they need not necessarily be so. It is important that the structural link between the first and second annular interface surfaces 110, 112 extends the length of the interface between the impact tip 104 and the support body 106 but how this is achieved is not necessarily significant. For example, the structural link may simply be a chamfer on one of the annular interface surfaces 110, 112 or alternatively, a fillet.

The third annular joining surface 126 of the impact tip 104 and the first annular joining surface 116 of the support body 106 face each other but, aside from any dimples 129 which are optional, they do not abut one another. Additionally, the fourth annular joining surface 128 of the impact tip 104 and the second annular joining surface 120 of the support body 106 face each other but again, aside from any dimples 129, they do not abut one another. The impact tip 104 and the support body 106 are separated by a gap $G_2$ of approximately 0.2 mm measured at the first and second shoulders 122, 130. Gap $G_2$ provides space for braze material (not shown) to sit between the impact tip 104 and the support body 106. Similarly, Gap $G_3$ also provides space for additional braze material (not shown) to sit between the impact tip 104 and the support body 106. For assembly, the braze is supplied as a ring or annulus, such that two rings in gaps $G_1$ and $G_3$ are needed for this invention. However, once heated, the braze becomes molten and flows. Braze from the outer braze ring at $G_1$ wicks up the gap $G_2$, towards the inner braze ring at $G_3$, to further increase the length of the braze join. This significantly increases the strength of the join. Feasibly, more than two annular interface surfaces may be provided.

The impact tip 104 comprises a protective skirt portion 132. In this embodiment, the skirt portion 132 encompasses the central recess 124, the third annular joining surface 126 and second shoulder 130. When joined to the support body 106, the skirt portion 132 also encompasses the protrusion 114, the first annular joining surface 116 and first shoulder 122. The skirt portion 132 peripherally terminates broadly in line with the support body 106, at the meeting of the second and fourth annular joining surfaces 120, 128. The skirt portion 132 has a diameter $Ø_S$ (see FIG. 10) of at least 25 mm. Preferably, diameter $Ø_S$ is between 25 mm and 40 mm inclusively. This general arrangement is important since it means that for the same volume of carbide material in the impact tip 104, greater protection for the steel support body 106 is afforded. The volume of carbide material is simply redistributed to where it is needed most, with no additional cost. Notably, when diameter $Ø_S$ is at the upper end of the range, the impact tip 104 protrudes radially outwardly over the support body 106, thereby providing more side protection against abrasion for the pick tool 100.

In this embodiment, the two co-axial and annular interface surfaces 110, 112 have different widths, measured radially. However, it is envisaged that the interface surfaces 110, 112 may alternatively have the same width. It is preferable that the radial outer annular interface surface 112 is lesser in width that the radial inner annular interface surface 110 as this encourages the flow of braze material radially inwardly, thereby promoting an improved joint strength. The radial inner annular interface surface 110 has an outer diameter $Ø_{IRO}$ of approximately 15 mm and a width of approximately 5 mm. The radial outer annular interface surface 112 has an outer diameter of approximately 25 mm and a width of between 3 mm and 7 mm. The radial outer annular interface surface 112 has an inner diameter $Ø_{IRO}$ of between 17 mm and 22 mm, (e.g. 25 mm−3 mm=22 mm).

For clarity, the radial inner annular interface surface 110 comprises the first and third annular joining surfaces 116, 126. The radial outer annular interface surface 112 comprises the second and fourth annular joining surfaces 120, 128.

At an opposing end to the central recess 124, the impact tip 104 has a working surface 134 with a rounded geometry that may be conical, hemispherical, domed, truncated or a combination thereof. Other forms of tip are envisaged within the scope of the invention, such as those that are hexagonal, quadrangular and octagonal in lateral cross-section.

Figure 10:
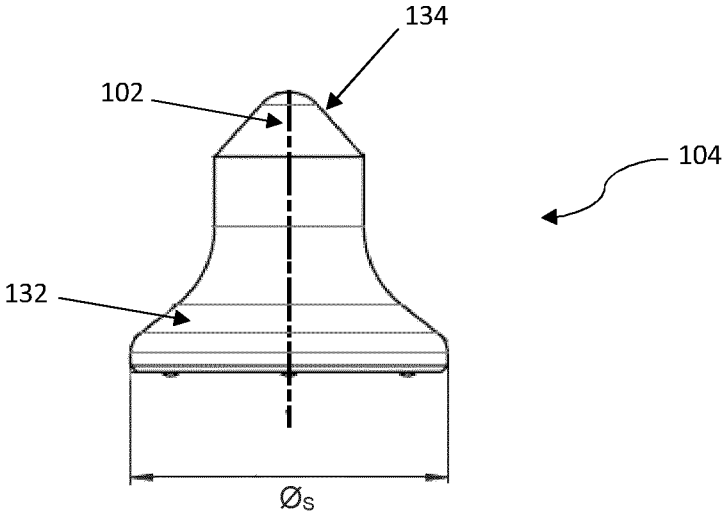
FIG. 10 shows a side view of the impact tip of FIG. 5.
Figure 11:
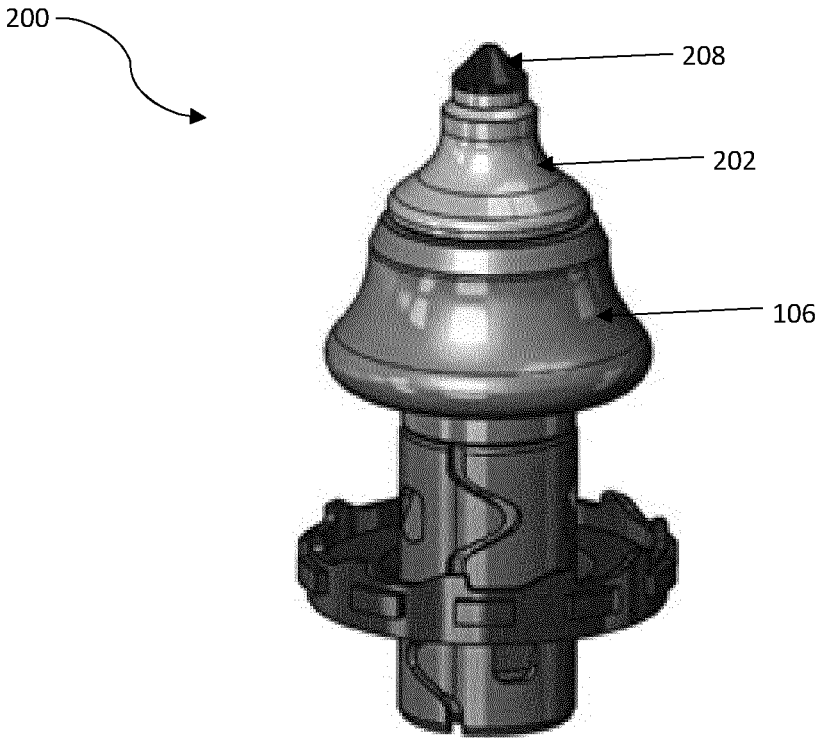
FIG. 11 shows a front perspective view of a pick tool in a further embodiment of the invention.

As best seen in FIG. 10, the impact tip 104, as a whole, is generally bell-shaped. The working surface 134 extends into and is co-linear with a cylindrical first body surface 136 of the impact tip 104. The first body surface 136, in turn, extends into and is co-linear with a curved second body surface 138 of the impact tip 104. Both the first and second body surface 136, 138 are continuous and uninterrupted, without any external grooves recessed therein. Similarly, the support body 106 has no external grooves of any kind.

In this embodiment, the impact tip 104 consists of cemented metal carbide material. In some embodiments, the support body 106 comprises a cemented metal carbide material having fracture toughness of at most about 17 $MPa \cdot m^{1/2}$, at most about 13 $MPa \cdot m^{1/2}$, at most about 11 $MPa \cdot m^{1/2}$ or even at most about 10 $MPa \cdot m^{1/2}$. In some embodiments, the support body 106 comprises a cemented metal carbide material having fracture toughness of at least about 8 $MPa \cdot m^{1/2}$ or at least about 9 $MPa \cdot m^{1/2}$. In some embodiments, the support body 106 comprises a cemented metal carbide material having transverse rupture strength of at least about 2,100 MPa, at least about 2,300 MPa, at least about 2,700 MPa or even at least about 3,000 MPa.

In some embodiments, the support body 106 comprises a cemented carbide material comprising grains of metal carbide having a mean size of at most 8 microns or at most 3 microns. In one embodiment, the support body 106 comprises a cemented carbide material comprising grains of metal carbide having a mean size of at least 0.1 microns.

In some embodiments, the support body 106 comprises a cemented metal carbide material comprising at most 13 weight percent, at most about 10 weight percent, at most 7 weight percent, at most about 6 weight percent or even at most 3 weight percent of metal binder material, such as cobalt (Co). In some embodiments, the support body 106 comprises a cemented metal carbide material comprising at least 1 weight percent, at least 3 weight percent or at least 6 weight percent of metal binder.

Turning now to FIGS. 11 to 18, alternative embodiments of a pick tool and/or impact tip in accordance with the invention are shown. These embodiments all have in common that they include a super-hard bit, as will be explained below. Similar features as those described with reference to the first embodiment are denoted using the same reference numerals, and for brevity, a further description is omitted.

The pick tool of FIGS. 11 to 16, indicated generally at 200, comprises a central axis 102, an impact tip 202 and a support body 106. As with the first embodiment, the pick tool 200 is symmetrical about its central axis 102. The impact tip 202 is, like the first embodiment, generally bell-shaped and flares radially outwardly at angle β (for example, see FIG. 15), which is around 100 degrees. The impact tip 202 has a proximal end 204 closest the support body 106, and an opposing distal end 206. The configuration of the impact tip 202 at the proximal end 204 is the same as the first embodiment. The configuration of the impact tip 202 at the distal end 206 is significantly different and is described below.

Figure 12:
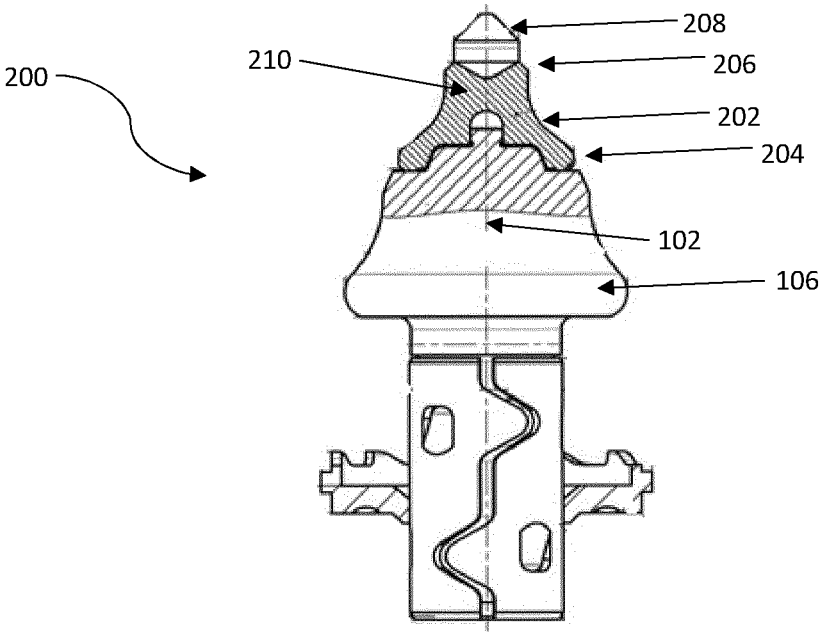
FIG. 12 shows a partial cross-sectional view of the pick tool of FIG. 11.
Figure 13:
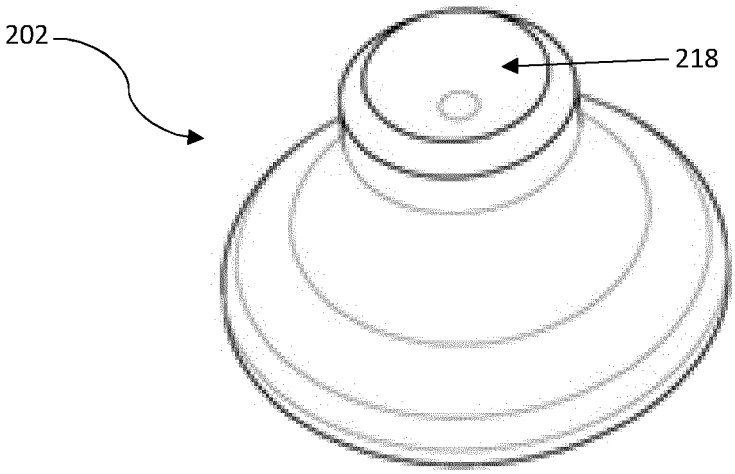
FIG. 13 shows a perspective view from above of the impact tip of FIG. 11.
Figure 14:
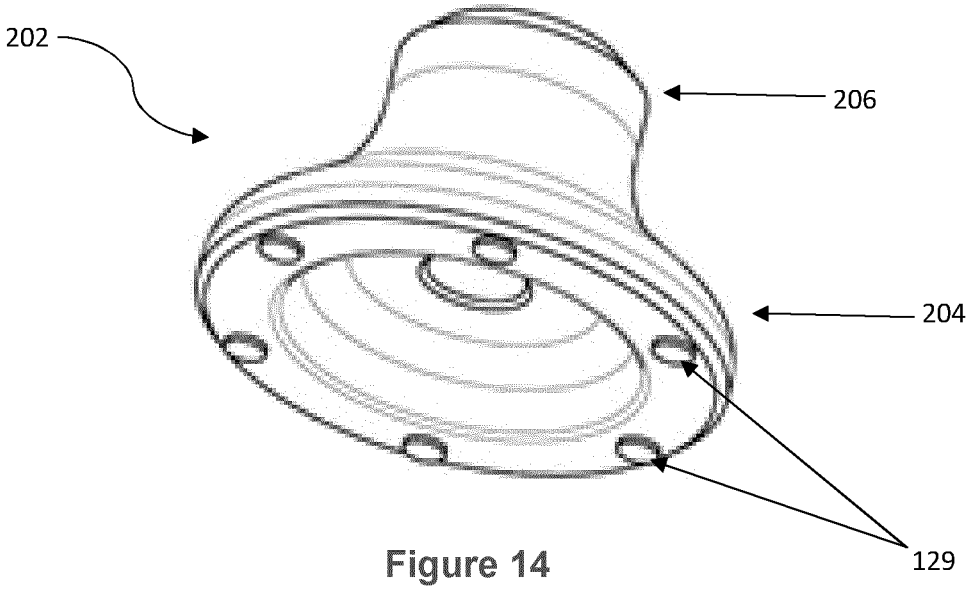
FIG. 14 shows a perspective view from below of the impact tip of FIG. 11.
Figure 15:
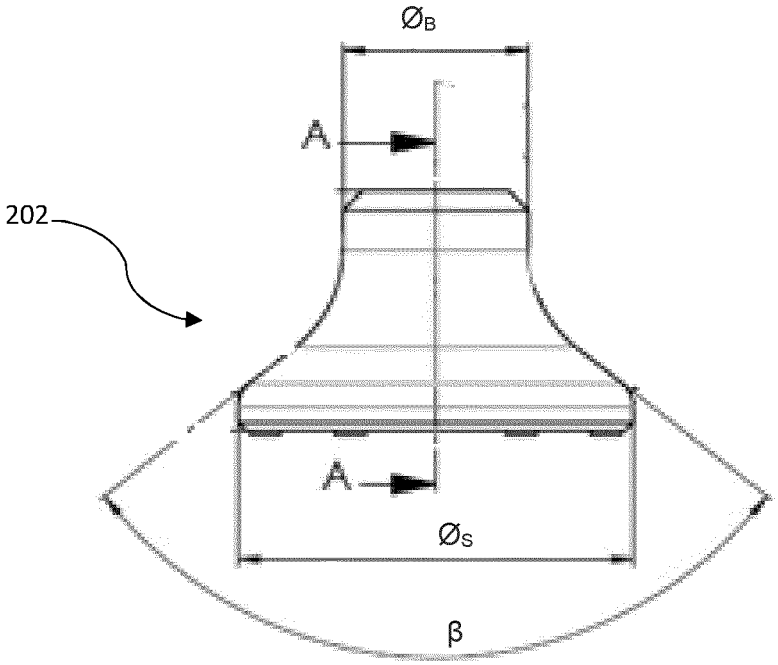
FIG. 15 shows a side view of the impact tip of FIG. 11.

The impact tip 202 comprises a super-hard bit 208 joined to a body portion 210, as shown in FIG. 12. Diameter $Ø_B$ (for example, see FIG. 15) of the body portion 210 is preferably around 12 mm. The join between the super-hard bit 208 and the body portion 210 is provided by conventional braze material.

Figure 17:
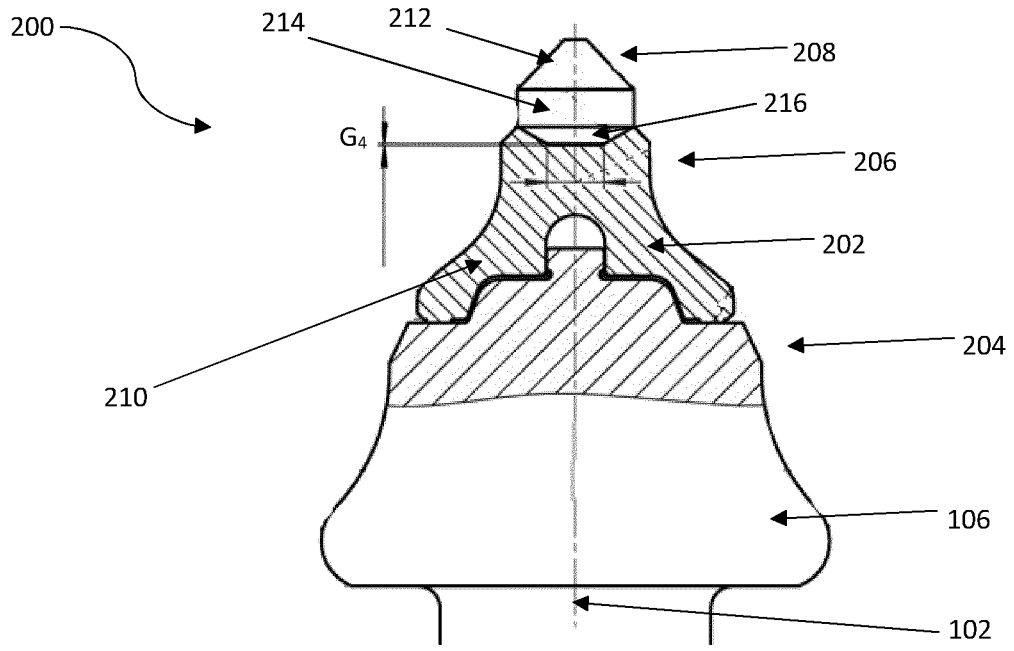
FIG. 17 shows a cross-sectional view of an alternative impact tip for use in the pick tool of FIG. 11.

As best seen in FIG. 17, the super-hard bit 208 comprises a super-hard volume 212 and a substrate 214. The super-hard volume 212 is sinter-joined to a distal end of the substrate 214. The super-hard volume 212 comprises polycrystalline diamond (PCD) material but alternatively could comprise polycrystalline cBN (PCBN) material. The working surface of the super-hard volume may be pointed, rounded or truncated in a known manner. As such, the super-hard volume may be generally hemi-spherical or conical or pyramidal or similar. Examples of super-hard volumes are given in the Applicant's own EP2795062B1, GB2490795A, WO2014/0491432A2, and WO2018/162442A1.

The overall shape of the super-hard bit may be generally circular, generally rectangular, generally pyramidal, generally conical, generally asymmetric, or combinations thereof.

The substrate 214 is usually cylindrical and typically comprises cemented metal carbide. This may be the same material as the material of the impact tip in the first embodiment. The interface between the super-hard volume 212 and the substrate 214 may be planar or non-planar.

The substrate 214 includes an integral base 216. In FIGS. 11 to 16, the base 216 has a conical configuration, tapering radially inwardly in a direction away from the interface with the substrate 214, and terminating in a curved apex with a constant radius. A maximum height of the cone, $H_1$, is around 2.3 mm. The base 216 also comprises cemented metal carbide.

In FIG. 17, the base 216 has a truncated conical configuration, tapering radially inwardly in a direction away from the interface with the substrate 214, and adjoining a planar end face.

In both embodiments, the distal end 206 of the impact tip 202 is correspondingly shaped to receive the base 216 of the super-hard bit 208. The impact tip 202 comprises a recess 218 for receiving the super-hard bit 208. Significantly less than 50% of the volume of the super-hard bit 208 is received into the impact tip 202. The configuration of the recess 218 is an inverted (truncated) cone, depending on the embodiment.

Figure 16:
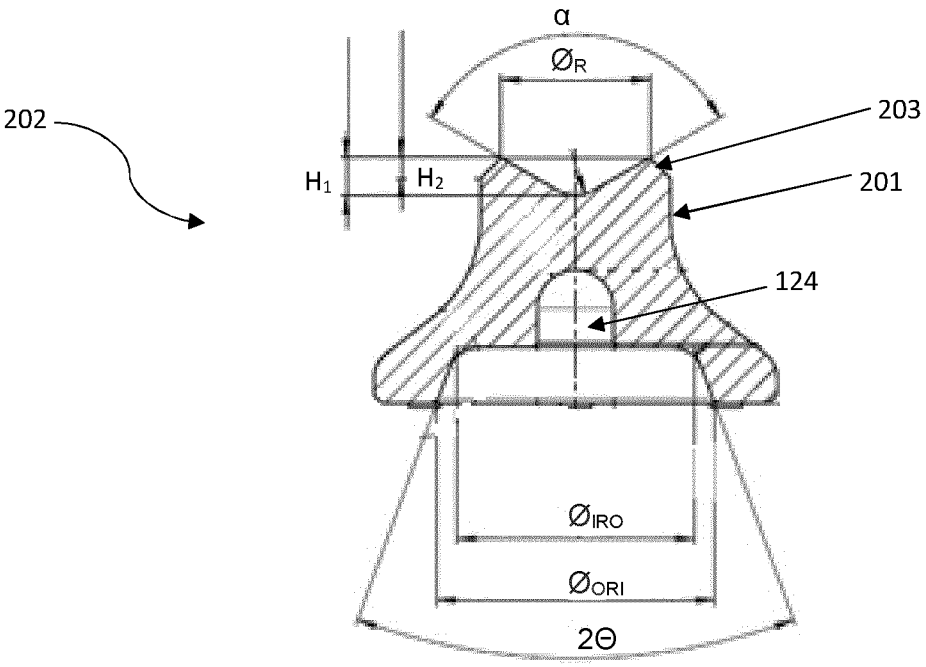
FIG. 16 shows a cross-sectional view of the impact tip of FIG. 16, along the lines A-A.

The purpose of this mating arrangement is to improve the length of the braze join between the super-hard bit 208 and the body portion 210, thereby improving the shear strength of the impact tip 202 as a whole. A very small gap $G_4$ of 0.1 mm is provided at the bottom of the recess 218 to allow for braze material. The angle of the cone, α, shown in FIG. 16, is typically around 120 degrees. The maximum internal diameter of the cone (i.e. at the base), $Ø_R$, is around 9.4 mm. A maximum height of the cone, $H_2$, is around 2.4 mm.

The arcuate sidewall 201 of the impact tip 202 is chamfered at the distal end 206 terminating in the peripheral edge of the recess 18, i.e. the measuring location of diameter $Ø_R$. The chamfered portion 203 of the sidewall 201 has a depth $H_2$ of around 1.3 mm.

Figure 18:
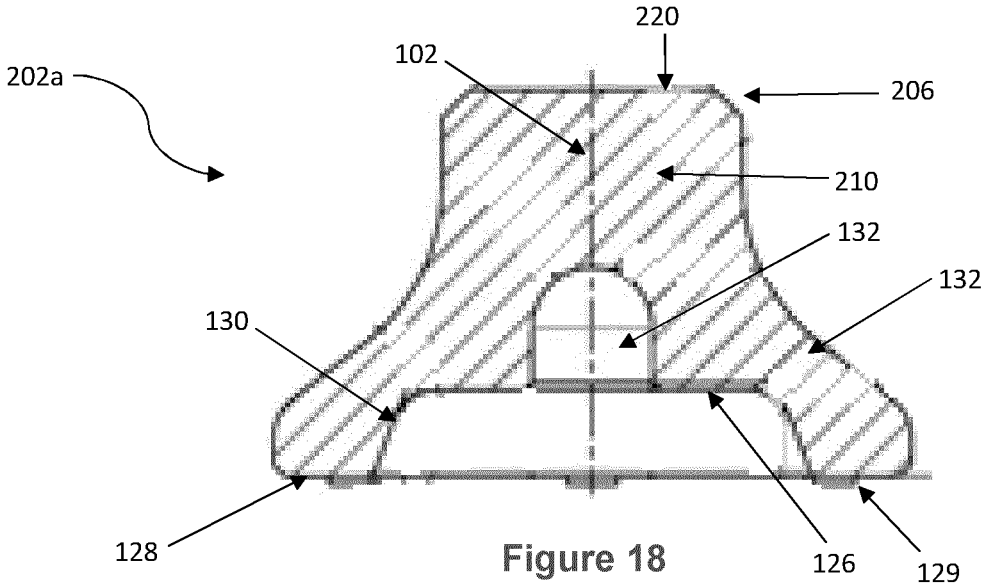
FIG. 18 shows an enlarged view of a further alternative embodiment of the impact tip.

In a yet further embodiment of the pick tool 200, the interface between the impact tip 202 and the super-hard bit 208 is planar and not generally conical. The corresponding impact tip 202*a* is shown in FIG. 18. The distal end 206 of the impact tip 202 has a flat circular end face 220. All other features of the impact tip 202 remain the same as described previously.

The combination of the two annular interface surfaces 110, 112 providing improved weld strength, and the protective skirt portion 132 providing improved protection of the support tool 106 together result in vastly superior pick tool 100 performance in use. Notably, the useful working lifetime (which may be measured in terms of time, metres cut or planed, number of operations etc) of the impact tool 100 is extended. When the central protrusion 114 and recess 134 arrangement is also included, this superior performance is obtainable with a redistribution of carbide material and little additional cost.

Certain concepts and terms as used herein will be briefly explained.

As used herein, a pick tool is for the mechanised degradation (or breaking) of a body, for example a geological formation, rocks, pavement, building constructions, or other bodies comprising or consisting of rock, coal, potash or other geological material, or concrete, or asphalt, as non-limiting examples. As used herein, degrading or breaking a body may include fragmenting, cutting, milling, planing or removing pieces of material from the body. A pick tool can be coupled to a drive apparatus for driving the pick against the body to be degraded, in which a strike tip comprised in the pick tool is driven to strike the body. In some examples, the drive apparatus may include a rotatable drum, to which a plurality of pick tools is coupled. Some pick tools may be used in mining operations or for boring into the earth; for example, pick tools may be used to mine coal or potash, or to drill into the earth in oil and gas extraction operations. Some picks may be used for milling road surfaces, for example road surfaces comprising asphalt or concrete.

Synthetic and natural diamond, polycrystalline diamond (PCD) material, cubic boron nitride (cBN) and polycrystalline cBN (PCBN) material are examples of super-hard materials. As used herein, PCBN material comprises grains of cubic boron nitride (cBN) dispersed within a matrix comprising or consisting essentially of metal or ceramic material. As used herein, polycrystalline diamond (PCD) material comprises an aggregation of a plurality of diamond grains, a substantial portion of which are directly interbonded with each other and in which the content of diamond is at least about 80 volume % of the PCD material. Interstices between the diamond grains may be at least partly filled with a filler material that may comprise catalyst material for synthetic diamond, or they may be substantially empty. As used herein, a catalyst material for synthetic diamond is capable of promoting the growth of synthetic diamond grains and or the direct inter-growth of synthetic or natural diamond grains at a temperature and pressure at which synthetic or natural diamond is thermodynamically stable. Examples of catalyst materials for diamond are Fe, Ni, Co and Mn, and certain alloys including these. Other examples of super-hard materials may include certain composite materials comprising diamond or cBN grains held together by a matrix comprising ceramic material, such as silicon carbide (SiC), or cemented carbide material, such as Co-bonded WC material. For example, certain SiC-bonded diamond materials may comprise at least about 30 volume % diamond grains dispersed in a SiC matrix (which may contain a minor amount of Si in a form other than SiC).

As used herein, sintered polycrystalline super-hard material is 'sinter-joined' when it becomes joined to a substrate in the same process in which the polycrystalline material is formed by sintering. Polycrystalline super-hard material, such as PCD or PCBN, may be formed by sintering raw materials including diamond or cBN grains, respectively, at an ultra-high pressure of at least about 2 GPa, at least about 4 GPa or at least about 5.5 GPa, and a high temperature of at least about 1,000° C., or at least about 1,200° C. The raw material, which may also include a non-super-hard phase or material, may be sintered in contact with a surface of a substrate, so that the sintered polycrystalline material becomes sinter-joined to the substrate during the sinter process. The sinter process may include molten cementing material from the substrate infiltrating among the plurality of super-hard grains within a precursor aggregation of super-hard grains. Bonding or cementing material from the substrate may be evident within the sintered super-hard volume, and/or phases or compounds including material from the substrate may be present within the super-hard volume adjacent the join boundary, and/or phases or compounds including material from the super-hard volume may be present in a volume of the substrate adjacent the join boundary. For example, the substrate may comprise cobalt-cemented tungsten carbide, and phases or compounds including tungsten (W) and/or cobalt (Co) may be present in the super-hard volume; and/or the super-hard material may comprise diamond and phases or compounds indicative of a high carbon (C) content may be present in the substrate; and/or the super-hard material may comprise cBN and phases or compounds including boron (B) and/or nitrogen (N) may be present in the substrate. In some examples, intrusions of Co (so-called 'plumes') from the substrate into the super-hard volume may be present at the join boundary.

The invention claimed is:

1. A pick tool comprising a central axis, an impact tip and a support body, the impact tip comprising a super-hard bit at a distal end thereof, a proximal end of the impact tip joined to the support body at a non-planar first interface, the non-planar first interface comprising two co-axial and annular interface surfaces that extend radially outwardly, perpendicular to the central axis, the two interface surfaces being non-concentric and spaced apart axially, wherein an inner interface surface is axially intermediate an outer interface surface and wherein a width of the outer interface surface is less than a width of the inner interface surface, the width being an extension in a radial direction.

2. A pick tool as claimed in claim 1, in which the impact tip comprises a body portion and the super-hard bit is joined to the body portion at a second interface.

3. A pick tool as claimed in claim 2, in which the second interface is planar.

4. A pick tool as claimed in claim 2, in which the second interface is conical or truncated conical.

5. A pick tool as claimed in claim 2, in which the impact tip comprises a protective skirt portion adjoining the body portion.

6. A pick tool as claimed in claim 5, in which the skirt portion has a diameter of between 25 mm and 40 mm.

7. A pick tool as claimed in claim 1, in which the super-hard bit comprises synthetic or natural diamond grains, or cBN grains.

8. A pick tool as claimed in claim 7, in which the super-hard bit comprises polycrystalline diamond (PCD) material or polycrystalline cBN (PCBN) material.

9. A pick tool as claimed in claim 1, in which the support body comprises a central protrusion, and the impact tip comprises a correspondingly shaped central recess for receiving the central protrusion.

10. A pick tool as claimed in claim 9, in which the central protrusion is undercut by a notch.

11. A pick tool as claimed in claim 9, in which the central protrusion comprises a cylindrical body portion.

12. A pick tool as claimed in claim 9, the support body comprising a first annular joining surface surrounding and extending from the central protrusion, the first annular joining surface connected to a radially outer second annular joining surface, the impact tip comprising a third annular joining surface surrounding and extending from the central recess, the impact tip further comprising a radially outer fourth annular joining surface connected to the third annular joining surface, wherein the third annular joining surface of the impact tip and the first annular joining surface of the support body face each other, and the fourth annular joining surfaces of the impact tip and the second annular joining surface of the support body face each other.

13. A pick tool as claimed in claim 12, in which the first annular joining surface of the support body is connected to the second annular joining surface of the support body at a shoulder.

14. A pick tool as claimed in claim 13, in which the impact tip and support body are separated by a gap of at least 0.2 mm measured along the shoulder.

15. A pick tool as claimed in claim 1, in which the impact tip comprises dimples.

16. A pick tool as claimed in claim 1, in which the pick tool is a road milling tool.

* * * * *